US012253340B1

(12) United States Patent
Beal

(10) Patent No.: US 12,253,340 B1
(45) Date of Patent: Mar. 18, 2025

(54) THERMAL TIPPED PENETRATOR BULLET

(71) Applicant: True Velocity IP Holdings, LLC, Garland, TX (US)

(72) Inventor: Harold F. Beal, University Park, TX (US)

(73) Assignee: True Velocity IP Holdings, Inc., Garland, TX (US)

( * ) Notice: Subject to any disclaimer, the term of this patent is extended or adjusted under 35 U.S.C. 154(b) by 0 days.

(21) Appl. No.: 18/241,845

(22) Filed: Sep. 1, 2023

(51) Int. Cl.
*F42B 12/44* (2006.01)
*F42B 12/06* (2006.01)
*F42B 12/78* (2006.01)

(52) U.S. Cl.
CPC ..... *F42B 12/44* (2013.01); *F42B 12/06* (2013.01); *F42B 12/78* (2013.01)

(58) Field of Classification Search
CPC ..... F42B 12/44; F42B 12/06; F42B 12/78
See application file for complete search history.

(56) References Cited

U.S. PATENT DOCUMENTS 1,380,773 A * 6/1921 Clay ..... F42B 12/40 102/518
1,730,871 A * 10/1929 Aronson ..... F42B 12/34 102/509
2,321,344 A * 6/1943 Whipple ..... F42B 12/34 102/509
2,327,950 A * 8/1943 Whipple ..... F42B 12/34 102/507
2,402,018 A * 6/1946 Burdett ..... F42B 12/44 86/51
2,683,416 A * 7/1954 Keller ..... F42B 12/06 102/513
2,975,710 A * 3/1961 Read ..... F42B 12/06 102/364
3,349,711 A * 10/1967 Darigo ..... F42B 12/80 102/514
3,745,077 A * 7/1973 Jones ..... F42B 12/44 148/26
3,782,287 A * 1/1974 Sie ..... F42B 12/78 102/516

(Continued)

FOREIGN PATENT DOCUMENTS

EP 2498046 A1 9/2012
WO 2018218292 A1 12/2018

*Primary Examiner* — Joshua E Freeman
(74) *Attorney, Agent, or Firm* — Burdick Patents, P.A.; Sean D. Burdick; Colin L. Honan

(57) ABSTRACT

A penetrating bullet, for use in an ammunition cartridge, has a jacket defining an internal volume and forming a closed base end opposite a nose end. A penetrator shaft is enclosed within the jacket and extends from the internal surface of the closed base end toward the nose end. Substantially filling the remainder of the internal volume is a core. The core is formed of two distinct regions, with a first stable region formed proximate the closed base end and extending to an intermediate location about the penetrator shaft. Forward from the stable region is a thermal region. The thermal region extends from the intermediate location to the nose end. The thermal region will ignite upon impact with a target to soften or otherwise weaken the target, allowing the penetrator shaft to more effectively penetrate deeper into the target medium.

19 Claims, 2 Drawing Sheets

(56) References Cited

U.S. PATENT DOCUMENTS 3,866,536 A 2/1975 Greenberg
4,353,302 A * 10/1982 Strandli ..... F42B 12/204 102/518
4,435,887 A * 3/1984 Strandli ..... F42B 12/06 29/520
4,444,112 A * 4/1984 Strandli ..... F42B 12/06 102/518
4,612,860 A * 9/1986 Flatau ..... F42B 12/06 102/501
4,625,650 A * 12/1986 Bilsbury ..... F42B 12/08 102/516
5,020,439 A * 6/1991 Winter ..... F42B 12/204 102/518
5,069,139 A * 12/1991 Denis ..... F42B 12/78 102/516
5,164,533 A * 11/1992 Schluckebier ..... F42B 12/204 86/20.14
6,070,532 A 6/2000 Halverson
6,286,433 B1 * 9/2001 Borg ..... F42B 12/06 102/516
6,457,417 B1 10/2002 Beal
6,607,692 B2 8/2003 Beal
7,069,834 B2 7/2006 Beal
7,243,588 B2 7/2007 Beal
9,702,678 B1 * 7/2017 Moretti ..... F42B 12/44
10,436,557 B2 * 10/2019 Stakes ..... F42B 12/44
10,578,413 B1 * 3/2020 Burke ..... F42B 12/74
11,293,730 B1 * 4/2022 Burke ..... F42B 12/16
2003/0150349 A1 * 8/2003 Beal ..... F42B 12/24 102/514
2005/0000385 A1 * 1/2005 Booth ..... F42B 12/78 102/514
2008/0196616 A1 8/2008 Cziglenyi
2009/0293755 A1 * 12/2009 Riess ..... F42B 12/74 102/507
2012/0090492 A1 * 4/2012 Rebar ..... F42B 12/34 102/517
2012/0272855 A1 * 11/2012 Rebar ..... F42B 12/34 102/517
2013/0092041 A1 4/2013 Seecamp
2016/0282097 A1 * 9/2016 Henry, III ..... F42B 33/00
2018/0156589 A1 * 6/2018 Reuther ..... C06B 23/008
2018/0156590 A1 * 6/2018 Reuther ..... F42B 12/382
2018/0313639 A1 11/2018 Peterson
2019/0017789 A1 * 1/2019 Burczynski ..... F42B 30/02
2019/0017791 A1 * 1/2019 Conroy ..... F42B 12/78
2019/0277610 A1 9/2019 Eberhart
2022/0065598 A1 * 3/2022 Lafortune ..... F42B 8/12
2022/0341718 A1 * 10/2022 Jones ..... F42B 12/78
2022/0412706 A1 * 12/2022 Burke ..... F42B 12/16
2024/0318944 A1 * 9/2024 Finsterbusch ..... F42B 12/08

* cited by examiner

THERMAL TIPPED PENETRATOR BULLET

BACKGROUND OF THE INVENTION

Field of the Invention

The inventive concepts disclosed herein relate generally to projectiles, and, more particularly, to jacketed projectiles engineered with a penetrating shaft and an incendiary region.

Description of Related Art

Ammunition cartridges of the type commonly used in modern firearms are generally well known in the art. These ammunition cartridges typically include a cylindrical case that carries an internal payload, e.g., propellant powder, and has an open end for receiving a projectile. The size and shape of the cartridge and corresponding projectile is largely dependent on the firearm used and caliber thereof. The end opposite the projectile receiving end is typically closed about a means for igniting the internal payload, e.g., a primer disposed in the base end of the cartridge. When chambered in a firearm, the projectile will engage the bore of the firearm barrel while the base end faces a firing mechanism, e.g., firing pin. When the primer is struck by the firing pin, a flash is produced which ignites the internal payload to propel the projectile down the bore and out the firearm.

Ignition of the internal payload releases a substantial amount of energy to propel the projectile down the bore of the firearm barrel at significant velocities, e.g., upwards of 3,000 feet per second. The projectile must thus be durable enough to withstand the initial shock of the released energy while maintaining its aerodynamic design to efficiently travel through the air toward the desired target. Projectiles, particularly bullets used in small and medium caliber firearms, thus share several common design features to achieve and maintain the necessary aerodynamic design. Typically, a bullet is designed with a forward end tapering inward toward the nose. This inward taper at the forward end is known as the ogive or ogive region. In similar fashion, the base end of a bullet may include an inward taper forming what is referred to as a boat tail.

The ogive and boat tail combination is known to produce an aerodynamic efficient bullet. Conventional bullets are commonly made from malleable metallic materials, such as lead, and can be seated in an external jacket of a different metal, such as copper. These bullets are typically formed by seating a lead core in a cup-shaped disc of jacket materials, e.g., a copper cup-shaped disc. The core and jacket then pass through a series of mechanical die presses that stretch and form the material into the final shape.

In certain military and law enforcement operating environments, it may be desirable to have bullets that can readily penetrate a surface before reaching the ultimate target without experiencing a significant loss in ballistic performance and/or structural integrity, e.g., armor piercing projectiles. This has prompted several bullet designs over the years, each with their own drawbacks and limitations. Early iterations of armor piercing projectiles typically relied on a solid projectile being formed from an especially hard metal, such as chromium stainless steels, that could penetrate a surface based on the hardness of the solid material. These projectiles, however, were relatively heavy, thereby limiting the effective range of the projectile and requiring larger caliber weapons capable of withstanding the larger internal payload required for firing. In more modern armor piercing bullets for small and medium caliber firearms, e.g., rifles and pistols, a pointed mass of high density material is typically encased in a jacket, similar to how non-armor piercing jacketed lead bullets are formed. A downside to these bullets is that the high density material encased within the jacket may fragment upon initial impact with a target, thereby limiting the penetrating ability of the bullet. Bullets which fail to fully penetrate a hardened target, such as an armored vehicle, can be potentially disastrous when used in a military or law enforcement operation where an enemy target cannot be effectively neutralized from a safe distance.

Thus, what is needed is bullet engineered to fully penetrate a hardened target without substantial loss in ballistic performance or destruction of the structural integrity of the bullet upon initial impact.

SUMMARY OF THE INVENTION

The invention disclosed herein is an engineered bullet effective against hardened or otherwise armored targets. The disclosed bullet has an internal, hardened penetrator shaft that is encompassed by two distinct core regions designed to increase the penetrability of the penetrator shaft. The core regions are engineered to provide stability about the penetrator shaft and produce an instant micro-ignition upon impact with a target to weaken the target thereby allowing deeper penetration of the bullet therein.

In some preferred embodiments, a projectile for an ammunition cartridge is disclosed. The projectile has a jacket defining an internal volume. The jacket has a closed base end opposite a nose end. A penetrator shaft is at least partially enclosed within the internal volume of the jacket. The penetrator shaft extends from the base end toward the nose end. The remainder of the internal volume is substantially filled with a bullet core. The core is composed of two distinct regions, which include a stable region and a thermal region. The stable region is formed of a first material and extends from the base end toward an intermediate location about the longitudinal length of the penetrator shaft. The thermal region is formed from a second material that is combustible upon impact with a target. The thermal region extends from the intermediate location about the penetrator shaft to the nose end of the jacket.

Ignition of the thermal region upon impact with a target occurs solely based on the inherent chemical properties of the second material. In some embodiments, the second material may be aluminum in powdered form or may be magnesium in powdered form. Alternatively, it may be a mixture of powdered aluminum and powdered magnesium. Various other combustible materials may be used to make the thermal region of the core in alternative embodiments and depending on the final use of the penetrating bullet.

The penetrator shaft may be tapered. In preferred embodiments, the penetrator shaft is tapered from the closed base end toward the nose end. The core may comprise a reverse taper, from the nose end to the closed base end, substantially filling the remaining internal volume after the penetrator shaft has been placed. In preferred embodiments, the penetrator shaft is concentrically aligned about the longitudinal centerline of the jacket. The penetrator shaft may be fully contained within the jacket. In such embodiments, the nose end of the jacket may be formed as a hollow point tip, rounded nose, or pointed tip. Alternatively, the penetrator shaft may extend beyond the nose end of the jacket to form the tip of the bullet. In such embodiments, the tip of the penetrator shaft may be pointed or rounded to form a pointed or rounded nose for the penetrating bullet.

The penetrator shaft is preferably composed of a material that is harder than the material forming the jacket. In some preferred embodiments, the penetrator shaft is formed from tungsten or a tungsten alloy material. In alternate embodiments, the penetrator shaft may be formed from other hard metals, such as a hardened steel or titanium.

In some embodiments, the jacket may include a means for matingly engaging with the penetrator shaft. The engagement means may be a pair of grooves formed on the internal surface of the closed base end and configured to receive the lower end of the penetrator shaft. The penetrator shaft may include a pair of corresponding protrusions that lock into the grooves formed in the jacket. In preferred embodiments, the pair of grooves and corresponding protrusions are spaced apart by about 90 degrees. The stable region of the core thereafter creates a seal about the lower end of the penetrator shaft to lock the protrusions into engagement with the grooves.

In further embodiments, the penetrating bullet may include a reinforcement disk engaged to the base end of the bullet. The reinforcement disk may be positioned between the closed base end and the lower end of the penetrator shaft on an internal surface of the jacket. Alternatively, the reinforcement disk may be engaged to the external surface of the closed base end. The reinforcement disk is preferably configured as a hard, circular disk that acts as a hard backstop against the penetrator shaft upon impact with a target. The reinforcement disk therefore can aid in thrusting the penetrator shaft forward through a target upon impact and reduces the loss of momentum after the initial impact.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. Dimensions shown are exemplary only. In the drawings, like reference numerals may designate like parts throughout the different views, wherein:

DETAILED DESCRIPTION OF THE INVENTION

The following disclosure presents exemplary embodiments of a bullet engineered to fully penetrate a hardened target surface without substantially fragmenting or otherwise destroying the internal hardened bullet core. The bullet is engineered such that a distinct portion of the internal volume formed within the jacket can be filled with a flammable or incendiary material that will ignite upon initial impact with a target. The ignition of the flammable material creates a micro-oven at the target which softens the target such that the internal harden core can more effectively penetrate the target without destroying itself on impact. The penetrating bullet disclosed herein is thus particularly well suited for military and law enforcement uses and can be manufactured in virtually any caliber desired. These and other aspects of the invention will become apparent to those skilled in art in view of the following disclosure.

Note, throughout the disclosure the phrase "hardened target" or "armored target" should be understood to mean an armored target or a target that has otherwise been fortified against conventional small and medium caliber bullets. Thus, hardened or armored targets may include personal body armor, armored vehicles, armored or concrete bunkers and other fortifications that may be used to protect a target. Further, throughout the disclosure, the terms "polymer" and "synthetic polymer" and "synthetic coating" shall be interpreted in a non-limiting fashion and given a broad interpretation according to their plain and ordinary meaning. "Polymer" can mean a natural polymer or a synthetic polymer, and any invention described herein that refers to polymer shall be understood to mean either a synthetic or natural polymer. Examples of polymers as used herein include but are not limited to acrylic, polyethylene, polyolefin, polypropylene, polystyrene, polyvinylchloride, synthetic rubber, phenol formaldehyde, neoprene, nylon, polyacrylonitrile, PVB, silicone, and any of the foregoing in powdered, micronized powdered, or resin form.

Figure 1:
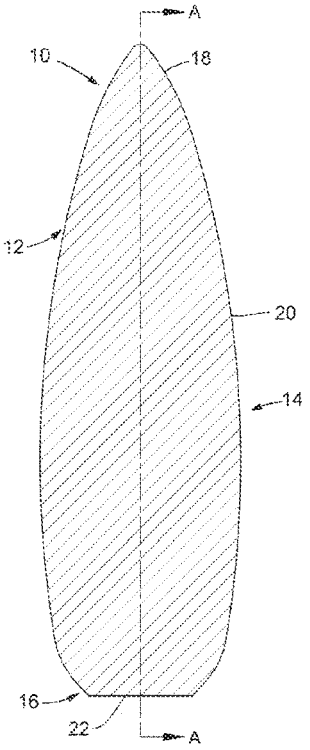
FIG. 1 is a side view of one embodiment of a penetrating bullet according to the present invention.

FIG. 1 is a side view of one embodiment of a penetrating bullet 10 according to the present invention. The penetrating bullet 10 tapers inwardly at the forward end to form an ogive region 12. Opposite the ogive region 12, the penetrating bullet 10 tapers inwardly to define a boat tail 16. The boat tail 16 defines the base end 22 of the penetrating bullet 10. Opposite the base end 22, the penetrating bullet 10 has a nose end 18 which is integrally connected to the base end 22 by the body 14. The body 14 defines the maximum outer diameter for the penetrating bullet 10, which is determined as a result of the caliber of the bullet. The penetrating bullet 10 is enclosed by a jacket 20 which forms the outer most surface of the penetrating bullet. Preferably, the jacket 20 has a smooth outer surface, however, in some alternative embodiments, the jacket 20 may include a circumferential groove to allow for crimping of a cartridge neck thereabout, e.g., a cannelure.

In alternative embodiments, the base end 22 may be formed as a flat base without the boat tail 16. In such embodiments, the base end 22 can have substantially the same outer diameter as the body 14 of the penetrating bullet 10. The nose end 18 may also be formed with a rounded or pointed tip, depending on the desired use of the penetrating bullet 10. Alternatively, the nose end 18 may be formed as a hollow tip (e.g., FIG. 5). As will be detailed further below, in some embodiments, the jacket 20 may be injection molded, according to known techniques, using one or more polymer or metallic powders. Alternatively, the jacket 20 may be formed according to conventional practices using a metallic cup that is stretched and formed into final shape through a series of mechanical die presses.

Figure 2:
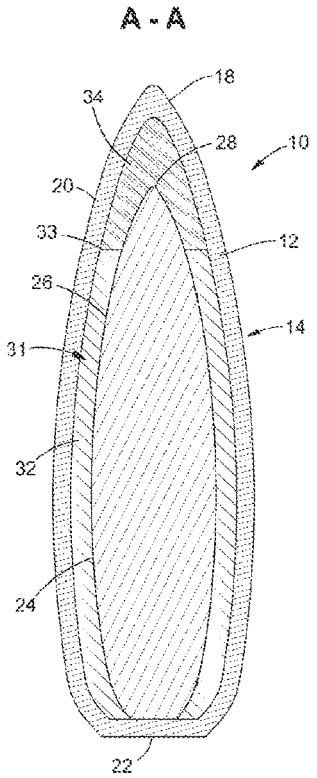
FIG. 2 is a side cross-sectional view, taken along section lines A-A of FIG. 1, of one embodiment of a penetrating bullet.
Figure 3:
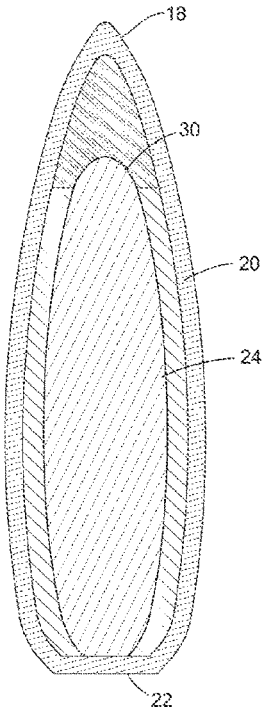
FIG. 3 is a side cross-sectional view, taken along section lines A-A of FIG. 1, of an alternative embodiment of a penetrating bullet according to the present invention.

FIG. 2 is a cross-sectional side view, taken along section lines A-A of FIG. 1, of an embodiment of a penetrating bullet 10 according to the present invention. The jacket 20 defines an internal volume of the penetrating bullet 10. The jacket 20 encloses a penetrator shaft 24. The penetrator shaft 24 extends from the base end 22 toward the nose end 18 within the jacket 20. In some embodiments, the penetrator shaft 24 extends about the full internal longitudinal length of the jacket 20 from the base end 22 to the nose end 18. In some alternative embodiments, the length of the penetrator shaft 24 may be less than the full length from the base end 22 to the nose end 18. A forward end 26 of the penetrator shaft 24 may taper inward to form a pointed tip 28. Alternatively, as shown in FIG. 3, the penetrator shaft 24 may have a rounded tip 30. The exact longitudinal length of the penetrator shaft 24 may be used to control the cross-sectional density of the penetrating bullet 10, where a longer length increases the cross-sectional density, which in turn increases the penetrability of the penetrating bullet 10. Similarly, the degree of taper for the forward end 26 of the penetrator shaft may be used to control the cross-sectional density of the penetrating bullet 10.

The penetrator shaft 24 is preferably composed of a hard metal that will not easily deform or otherwise fragment upon impact with a hardened target. In preferred embodiments, the penetrator shaft 24 is made from tungsten or tungsten alloy materials, such as tungsten carbide. However, in alternative embodiments, the penetrator shaft 24 may be formed from other hard metals, such as various grades of hardened steel, titanium, and other metals or metal alloys with physical properties similar to tungsten. Note, the actual material used for the penetrator shaft 24 may vary depending on the hardened target the penetrating bullet 10 is designed for use against and the degree of penetration that may be required. The penetrator shaft 24 is preferably a solid piece of metal that is centered and balanced in the jacket 20 during the formation process of the penetrating bullet 10. Alternatively, the penetrator shaft 24 may be formed from metal powders that have either been heated and injection molded into form according to known techniques or mechanically compressed into the desired shape.

The remainder of the internal volume formed by the jacket 20 after the penetrator shaft 24 is seated therein is completely filled with a reverse tapered core 31. The reverse tapered core 31 fills the volume left between the outer surface of the penetrator shaft 24 and the inner surface of the jacket 20. The reverse tapered core 31 is formed from two distinct regions that are composed of different materials. A stable core region 32 is formed proximate the base end 22 about the penetrator shaft 24. The stable core region 32 extends forward to an intermediate position 33 defined about the longitudinal length of the penetrator shaft 24, preferably somewhere along the taper of the forward end 26 of the penetrator shaft 24. The stable core region 32 can be made from tin, lead or other metals or polymeric materials that will not react under the intense heat and pressure generated upon initial impact with a target. The stable core region 32 is thus composed of a metal or polymer material that is insensitive to heat changes and will not chemically react due to external forces at impact, e.g., friction generated upon impact with a target. The stable core region 32 can be injection molded into the penetrating bullet 10 about the penetrator shaft 24. In some embodiments, the stable core region 32 is made from a material that is less dense than lead to reduce the overall mass of the penetrating bullet 10 in comparison to a conventional bullet of similar caliber and shape.

Extending forward from the intermediate position 33 and substantially filling the remaining internal volume of the jacket 22 is a thermal core region 34. The thermal core region 34 surrounds at least the tip 28 of the penetrator shaft 24 and fills any remaining void proximate the nose end 18 within the jacket 20. The thermal core region 34 is designed to ignite upon impact with a target based on the inherent chemical properties of the materials used. The materials making up the thermal core region 34 ignite based upon the heat generated by the initial impact of the penetrating bullet 10 with a target. Ignition of the thermal core region 34 is relatively quick but is concentrated at the impact area and can generate temperatures upwards of 5,000 degrees Fahrenheit. The concentration of extreme heat generated at the initial impact area by the thermal core region 34 is engineered to soften or otherwise weaken the impact area to allow the penetrator shaft 24 to more easily continue on its path through the now weakened/softened target surface and penetrate deeper into the target medium.

The thermal core region 34 may be composed of one or more metallic powders that are stable at standard environmental conditions but reactive in the presence of sufficient heat. Preferably, the thermal core region 34 is composed of metallic powders, such as aluminum or magnesium metal powders. In some embodiments, a mixture of aluminum and magnesium powders may be used to form the thermal core region 34. In alternative embodiments, a mixture of a flammable or incendiary material and a stable material may be used. For example, aluminum or magnesium metallic powders may be homogenously mixed with a tungsten metal powder to form the thermal core region 34. Mixing a stable material, such as a tungsten metal powder, with a flammable material, such as aluminum or magnesium, can increase the stability of the thermal core region 34 for purposes of transport and handling. Further, the mixture of a flammable material with a denser, stable material will aid in achieving proper balance of the penetrating bullet 10 by increasing the cross-sectional density of the forward end of the penetrating bullet 10.

Figure 4:
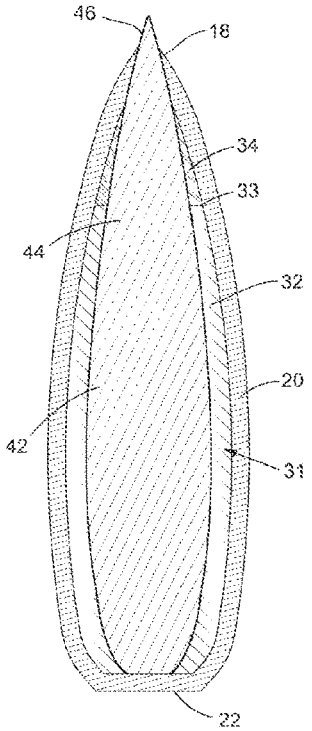
FIG. 4 is a side cross-sectional view, taken along section lines A-A of FIG. 1, of an alternative embodiment of a penetrating bullet having an elongated penetrator shaft.

FIG. 4 is a side cross-sectional view, taken along section lines A-A, of an alternative embodiment of an elongated penetrating bullet 40 according to the present invention. The elongated penetrating bullet 40 is similar to the penetrating bullet 10 and includes an extended penetrator shaft 42. The extended penetrator shaft 42 has a forward end 44 which tapers inwardly, similar to the forward end 26 described above. The tip 46 of the extended penetrator shaft 42 extends beyond the nose 18 of the jacket 20 to form the bullet nose. The extended penetrator shaft 42 therefore extends beyond the full longitudinal length of the jacket 20 from the base end 22 and through the nose 18. The extended penetrator shaft 42 further increases the cross-sectional density of the elongated penetrating bullet 40 which thereby increases the penetrability of the bullet in a target medium.

Figure 5:
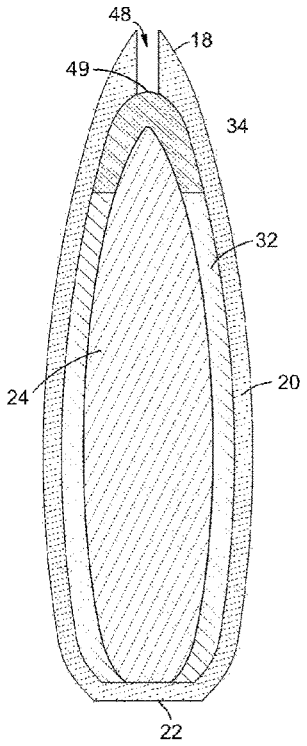
FIG. 5 is a side cross-sectional view, taken along section lines A-A of FIG. 1, of an alternative embodiment of a hollow point penetrating bullet according to the present invention.

FIG. 5 is a side cross-sectional view, taken along section lines A-A, of an alternative embodiment of the penetrating bullet 10. In some embodiments of the penetrating bullet 10, the nose end 18 may be formed as a hollow point 48. Formation of the hollow point 48 in the penetrating bullet 10 occurs as the final step after the penetrator shaft 24 has been secured within the jacket 20 and the stable core region 32 and the thermal core region 34 have been formed therein. The nose end 18 of the jacket 20 is thereafter extended and folded back in on itself to form the hollow point 48. The folding of the nose end 18 back in on itself also serves to create a seal 49 to close off the internal volume of the jacket 20 for the penetrating bullet 10 about the forward end thereof.

Figure 6:
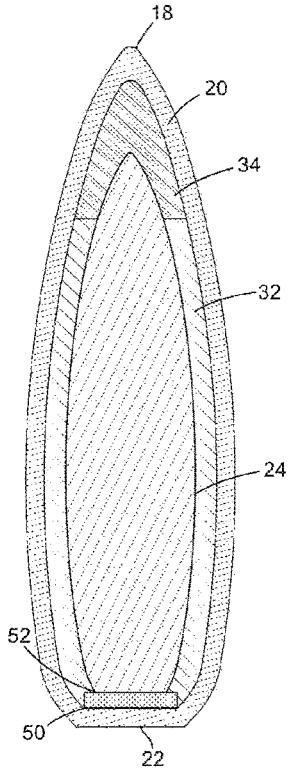
FIG. 6 is a side cross-sectional view, taken along section lines A-A of FIG. 1, of an embodiment of a reinforced penetrating bullet according to the present invention.
Figure 7:
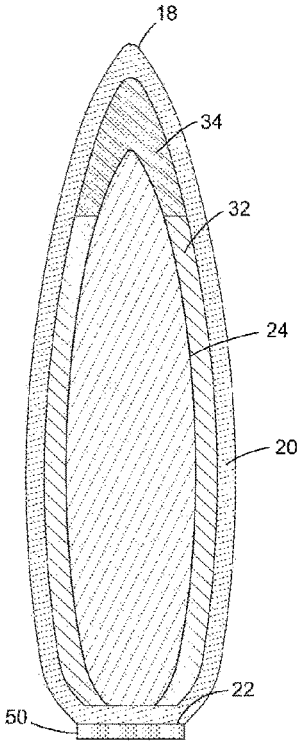
FIG. 7 is a side cross-sectional view, taken along section lines A-A of FIG. 1, of an alternative embodiment of the reinforced penetrating bullet according to the present invention.

FIGS. 6 and 7 illustrate various embodiments of a penetrating bullet 10 that includes a thrusting disk 50 attached thereto. FIG. 6 is a side cross-sectional view, taken along section lines A-A, of an alternative embodiment of the penetrating bullet 10. FIG. 7 is also a cross-sectional view of a further alternative embodiment of the penetrating bullet 10. The penetrating bullet 10 may include a thrusting disk 50 engaged about the rear end 52 the penetrator shaft 24 (e.g., FIG. 6). Alternatively, the thrusting disk 50 may be engaged externally about the base end 22 of the jacket 20 (e.g., FIG. 7). The thrusting disk 50 is preferably a hard circular disk and can be made from metal, such as steel, although other metals may also be acceptable.

The thrusting disk 50 increases penetration of the penetrator shaft 24 by continuing the momentum of the penetrating bullet 10 in the forward direction upon impact with a target. The thrusting disk 50 acts as a hard backstop for the penetrator shaft 24 to work against upon initial impact with a target to ensure the forward momentum of the penetrating bullet 10 is carried deeper into the target. Further, the thrusting disk 50 can aid in preventing or resisting the occurrence of the penetrator shaft 24 being pushed out the base end 22 upon impact with a target before achieving optimal penetration.

The thrusting disk 50 is securely engaged to the penetrating bullet 10 to avoid problems that may occur from the inadvertent disengagement of the thrusting disk from the bullet during flight. For instance, if the thrusting disk 50 becomes disengaged from the penetrating bullet 10, it could act as a secondary projectile with an unknown flight path, thereby posing an unintended threat downrange. Thus, in some preferred embodiments, the thrusting disk 50 is adhesively secured to the penetrating bullet 10. This may involve placement of a small amount of adhesive internally at the base end 22 of the jacket 20 prior to insertion of the penetrator shaft 24. Alternatively, the penetrating bullet 10 may be fully formed prior to the thrusting disk 50 being adhesively secured to the external surface of the base end 22. In some other alternative embodiments, the thrusting disk 50 may be spot welded, laser welded, sonic welded, chemically welded, soldered, mechanically pressed or some combination thereof to secure the thrusting disk to the penetrating bullet 10. In further alternative embodiments, the thrusting disk 50 and the portion of the jacket 20 with which it will be engaged may be textured prior to the adhesive bonding. The texturing applied to the thrusting disk 50 and corresponding portion of the jacket 20 increases the reliability of the adhesive bonding therebetween by increasing the surface area available for bonding.

Figure 8:
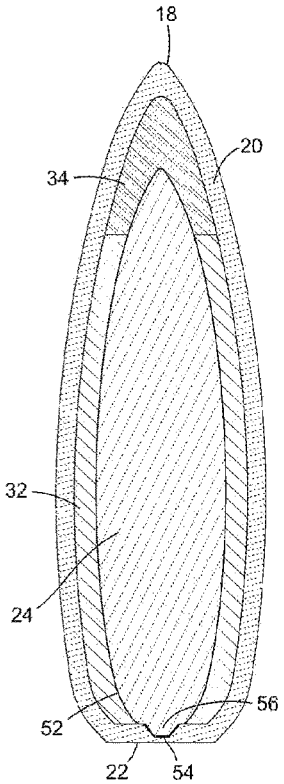
FIG. 8 is a side cross-sectional view, taken along section lines A-A of FIG. 1, of a further alternative embodiment of a penetrating bullet according to the present invention.
Figure 9:
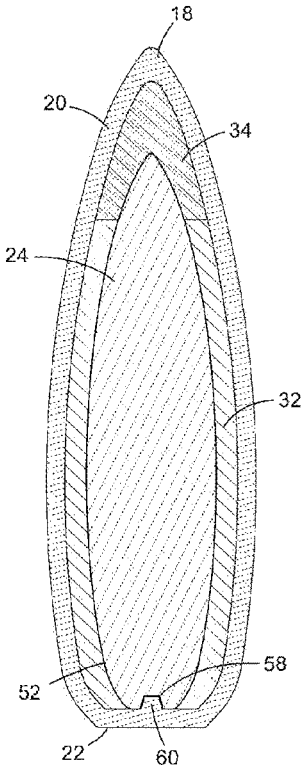
FIG. 9 is a side cross-sectional view, taken along section lines A-A of FIG. 1, of a further alternative embodiment of a penetrating bullet.

FIGS. 8 and 9 illustrate various embodiments of a penetrating bullet 10 having a means for securing and centering the penetrator shaft 24 within the jacket 20. FIG. 8 is a side cross-sectional view, taken along section lines A-A, of one embodiment for securing and centering the penetrator shaft 24 within the jacket 20 and FIG. 9 is a side cross-sectional view an alternative embodiment for securing and centering the penetrator shaft in the jacket. As shown in FIG. 8, the jacket 20 may be formed with at least one groove 54 defined on the internal surface of the base end 22. The groove 54 is configured to matingly engage with a corresponding protrusion 56 formed at the rear end 52 of the penetrator shaft 24. In preferred embodiments, there is at least two opposing grooves 54 separated by about 90 degrees that matingly engage with a pair of corresponding protrusions 56 formed about the lower end 52 of the penetrator shaft 24. In alternative embodiments, such as that illustrated in FIG. 9, the internal surface of the base end 22 of the jacket 20 may be formed with a protrusion 60 that will matingly engage with a corresponding groove 58 formed in the rear end 52 of the penetrator shaft 24. Preferably, there are two 90 degree opposing protrusions 60 that matingly engage with a corresponding pair of opposing grooves 58 formed in the penetrator shaft 24.

Regardless of the configuration, the combination of grooves 54, 58 matingly engaged with the corresponding protrusions 56, 60 ensures the penetrator shaft 24 will be secured internally to the jacket 20. Further, engagement between the grooves 54, 58 and the protrusions 56, 60 causes the concentric alignment of the penetrator shaft 24 within the jacket 20 to provide for proper balance of the penetrating bullet 10. This concentric engagement also ensures the penetrator shaft 24 and the jacket 20 will share and maintain a common axis of rotation during flight to avoid issues of bullet disintegration or unwanted yawing of the bullet during flight.

In some exemplary embodiments, the length of the penetrator shaft 24 may be equal to about 50% to 110% the longitudinal length of the jacket 20 from the base end 22 to the nose end 18. Thus, the penetrator shaft 24 can be fully contained within the jacket 20 (e.g., FIG. 2) or be extended out the nose end 18 (e.g., FIG. 4) to form the tip of penetrating bullet 10. The internal volume of the jacket 20 remaining after engagement of the penetrator shaft 24 therein is then filled with the core 31. In some embodiments, the stable core region 32 may fill 50% to 80% of the remaining internal volume of the jacket 20 and the thermal core region 34 fills the remaining 20% to 50% of the internal volume about the nose end 18. More reactive materials used for the thermal core region 34 may require less volume of material to achieve the desired effect. For example, using powdered magnesium to form the thermal core region 34 may require only about 20% volume to achieve the desired incendiary effect whereas using powdered aluminum mixed with a stable material (e.g., tungsten) for the thermal core region 34 may require 50% volume. However, the exact percentages for each region of the core 31 will be dependent on the numerous external factors, such as bullet caliber, type of ammunition cartridge used in conjunction with the penetrating bullet 10, and the intended hardened target the bullet will be used on.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A projectile for an ammunition cartridge, comprising:

a jacket defining an internal volume and having a closed base end and a nose end;

a penetrator shaft at least partially enclosed within the internal volume of the jacket and extending from the closed base end toward the nose end, wherein the closed base end has a means for engaging the penetrator shaft; and a core disposed within the jacket and around the penetrator shaft, the core having:

(1) a stable region composed of a first material and formed proximate the closed base end and extending forward to an intermediate location, and (2) a thermal region composed of a second material, the thermal region extending forward from the intermediate location toward the nose end, wherein the thermal region is configured to ignite upon impact with a target.

2. The projectile of claim 1, wherein the penetrator shaft is tapered from the closed base end toward the nose end.

3. The projectile of claim 2, wherein the core comprises a reverse taper from the nose end to the base end.

4. The projectile of claim 3, wherein the penetrator shaft and the core substantially fill the internal volume of the jacket.

5. The projectile of claim 1, wherein the engagement means comprises two grooves defined in an internal surface of the jacket at the base end and configured to receive a lower end of the penetrator shaft.

6. The projectile of claim 5, wherein the two grooves are spaced apart from one another by substantially 90 degrees.

7. The projectile of claim 6, wherein the lower end of the penetrator shaft further comprises at least two protrusions configured to mate with the two grooves formed in the base end.

8. The projectile of claim 7, wherein the stable region about the closed base end is configured to lock the two protrusions into mating engagement with the two grooves.

9. The projectile of claim 1, wherein the penetrator shaft is concentrically aligned about a longitudinal centerline of the jacket.

10. The projectile of claim 1, wherein a forward end of the penetrator shaft extends beyond the nose end of the jacket to define a bullet tip.

11. The projectile of claim 1, wherein the nose end of the jacket forms a hollow point tip.

12. The projectile of claim 1, wherein ignition of the thermal region upon impact with a target occurs solely based on inherent chemical properties of the second material.

13. The projectile of claim 12, wherein the second material is a compressed aluminum powder.

14. The projectile of claim 1, wherein the penetrator shaft is composed of a material harder than the jacket.

15. The projectile of claim 1, wherein the penetrator shaft is composed of tungsten.

16. The projectile of claim 1, further comprising a thrusting disk attached about the closed base end, the thrusting disk configured to thrust the penetrator shaft in a forward direction upon impact with a target.

17. A projectile for an ammunition cartridge, the projectile comprising:

a jacket defining an internal volume and having a base end and a nose end;

a penetrator shaft at least partially enclosed within the internal volume of the jacket, and extending from the base end toward the nose end, wherein the base end has a means for engaging the penetrator shaft;

a two-piece core disposed within the jacket and around the penetrator shaft, the two-piece core having a lower region composed of a first material and an upper region composed of a second material, wherein the second material is combustible upon physical impact with a surface.

18. The projectile of claim 17, further comprising a reinforcement disk attached to an outer surface of the base end and configured as a hard backstop to thrust the penetrator shaft forward upon impact with a target.

19. The projectile of claim 17, wherein the second material is a compressed magnesium powder.

* * * * *